United States Patent [19]

Kumar et al.

[11] Patent Number: 5,044,613

[45] Date of Patent: Sep. 3, 1991

[54] UNIFORM AND HOMOGENEOUS PERMANENT MAGNET POWDERS AND PERMANENT MAGNETS

[75] Inventors: Kaplesh Kumar, Wellesley; Anthony Petrovich, Tewksbury, both of Mass.

[73] Assignee: The Charles Stark Draper Laboratory, Inc., Cambridge, Mass.

[21] Appl. No.: 478,682

[22] Filed: Feb. 12, 1990

[51] Int. Cl.[5] ..... B22F 9/24

[52] U.S. Cl. ..... 266/170; 266/171; 266/202; 425/6

[58] Field of Search ..... 425/6, 7; 264/12; 266/170, 171, 195, 200, 202

[56] References Cited

U.S. PATENT DOCUMENTS

| | | | |
|---|---|---|---|
| 3,510,291 | 5/1970 | Brush | 75/355 |
| 3,764,295 | 10/1973 | Lindskog et al. | 264/12 |
| 4,023,961 | 5/1977 | Douglas et al. | 75/355 |
| 4,093,450 | 6/1978 | Doyle et al. | 75/365 |
| 4,264,641 | 4/1981 | Mahoney et al. | 427/30 |
| 4,383,852 | 5/1983 | Yoshizawa | 75/363 |
| 4,484,943 | 11/1984 | Miura et al. | 75/351 |
| 4,526,611 | 7/1985 | Yoshizawa et al. | 75/347 |
| 4,533,383 | 8/1985 | Miura et al. | 75/363 |
| 4,545,814 | 10/1985 | Chou et al. | 75/365 |
| 4,571,331 | 2/1986 | Endou et al. | 423/345 |
| 4,585,473 | 4/1986 | Narasimhan et al. | 264/12 |
| 4,778,517 | 10/1988 | Kopatz et al. | 264/12 |
| 4,869,469 | 9/1989 | Bylon et al. | 266/202 |

OTHER PUBLICATIONS

"Cobalt-Rare Earth Powders by the Reduction-Diffusion Process", by C. M. McFarland, General Electric Technical Information Series Report No. 73CRD035, Jan. 1973.

"Eds for the Preparation of a-$Fe_2O_3$", by Thomas P. O'Holleran et al., Ceramic Bulletin, vol. 57, No. 4 (1978), pp. 459-460.

"Preparation of Fine Oxide Powders by Evaporative Decomposition of Solutions", by Della M. Roy et al., Ceramic Bulletin, vol. 56, No. 11 (1977), pp. 1023-1024.

"Reduction-Diffusion Preparation of $Sm_2(Co, Fe, Cu, Zr)_{17}$ Type Alloy Powders and Magnets Made From Them", by Dong Li et al., Paper No. X-1 5th Int'l Workshop on Rare Earth-Cobalt Magnets, Jun. 1981.

*Primary Examiner*—R. Dean
*Assistant Examiner*—George Wyszomierski
*Attorney, Agent, or Firm*—Weingarten, Schurgin, Gagnebin & Hayes

[57] ABSTRACT

Method and apparatus for forming rare-earth magnets and magnet precursors of fine particle sized metal alloy powders with a high degree of metal to metal intimacy and homogeneity in the particle to particle metal composition. Salts of the desired metals which may include or be selected from zirconium, samarium, iron, cobalt, copper, neodymium and boron with nitric acid in a water based solution are atomized through a nozzle, which may be ultrasonic, into fine mist droplets form metal oxide particles which condense through a heated, atmospheric environment furnace. The furnace temperature is in a range of 600° to 1150° C. and causes decompositon of the metal salts along with their oxidation, driving off the liquid and nitrogen components along with other carrier materials. A very fine sized powder, typically micron dimension size powder of metal oxides, in which each particle represents a homogeneous proportion of the desired metal components, is collected in the bottom of the furnace. These fine particle metal oxide powders are subsequently reduced to metal alloy powder particles of similar homogeneity in the metal proportions. The reduction reaction typically utilizes calcium hydride in a hydrogen atmosphere to convert the metal oxides to metal alloy particles. The metal alloy powder is then aligned, compacted, densified and magnetized to produce magnets of high magnetic performance.

16 Claims, 2 Drawing Sheets

Ca 2

UNIFORM AND HOMOGENEOUS PERMANENT MAGNET POWDERS AND PERMANENT MAGNETS

FIELD AND BACKGROUND OF THE INVENTION

Rare-earth permanent magnets of such composition as 1-5 or 2-17 samarium cobalt, and iron-neodymium-boron, having a very high magnet performance, have been produced by consolidating powders of the metal alloy components to high densities. The powders produced for such consolidation have typically been produced by grinding as in ball mills.

Such magnets have produced remarkable improvements in the magnetic performance, particularly for small permanent magnet motors and similar devices. The higher magnetic performance placed demands upon metallurgical preparation of magnetic materials which it is not possible to address with the prior art techniques.

BRIEF SUMMARY OF THE INVENTION

Rare-earth permanent magnets of increased magnetic capability have been produced according to the present invention by first forming the metal powders from which the permanent magnets are produced after consolidation of an alloy powder with a very fine or small particle size and having high homogeneity in metal component proportions from particle to particle and high metal to metal intimacy unknown in the prior art.

Fine particle size powders of micron dimension or smaller are produced according to the invention by preparing a solution of metal salts. The metals are dissolved in nitric acid and the resulting solution sprayed through an atomizing nozzle capable of creating a mist of extremely fine solution droplets. The droplets precipitate through a furnace heated in the range of 600° C. to 1150° C. and comprising a vertical column open at its end to the atmosphere. The high temperature disassociates the metal salts, converting the metal components in each droplet to corresponding particles of metal oxide producing in very small particles a high homogeneity in metal component proportions from particle to particle and high intimacy of metal to metal contact. The high reaction temperature of the furnace drives the liquid component and the nitrogen-based reaction products off as volatiles exhausted from the top of the column while the metal oxide particles settle or condense on the collector at the bottom of the furnace column.

The metal oxide powder deposited on the collector is then reduced to powders of metal alloys having similar interparticle homogeneity and intimacy using a hydrogen reducing atmosphere and calcium or calcium hydride as a reducing agent. The reduced metal oxide powder particles form similarly proportioned and intimately contacting metal alloy powder particles.

The metal alloy powder particles are then consolidated and magnetized. Typically the powder particles are aligned, and cold compacted. Subsequently, the compacts are densified by sintering or hot isostatic pressing to produce the final magnetic element. The element is then magnetized to the desired magnetic properties and placed into services that require a high performance rare-earth permanent magnet.

DESCRIPTION OF THE DRAWINGS

These and other features of the present invention are more fully set forth below in the solely exemplary detailed description and accompanying drawing of which.

DETAILED DESCRIPTION

Rare-earth permanent magnets of high magnetic performance are achieved in the present invention by producing controllable, uniform small particle sized metal oxide powders of plural metal components wherein the components are present in proportions that remain homogeneous from particle to particle and in which the metal oxides of the different metal components are in high intimate contact with each other. The very small particle size and high uniformity and homogeneity ensures extremely uniform dispersal of the various metallic components throughout the oxide powder and, after oxide reduction, throughout the metal alloy particles. This high homogeneity produces uniform properties in the magnetic materials which permits them to take a high degree of magnetization and exhibit other properties associated with high performance magnet materials.

Figure 1:
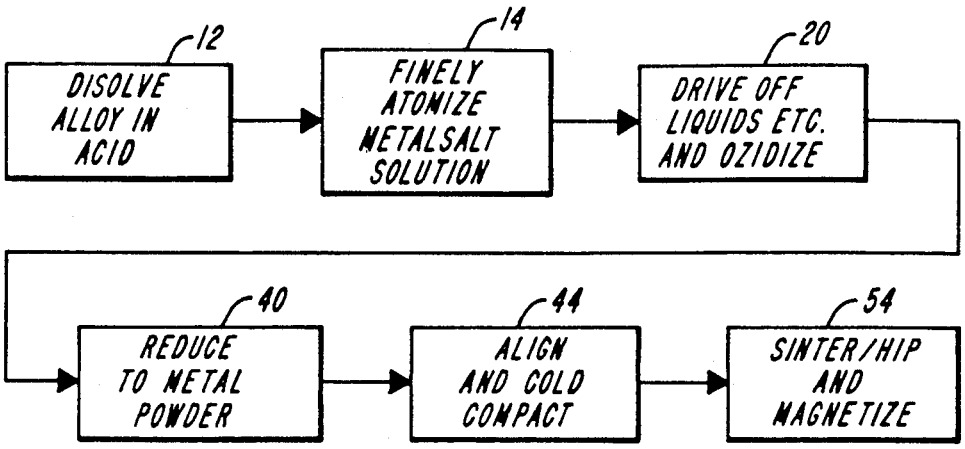
FIG. 1 is a flow chart illustrating the processing steps in providing rare-earth permanent magnets of high magnetic performance according to the present invention.

The process for production of such high performance magnets and magnet precursors or materials is illustrated in FIG. 1. As shown there, the metals, metal alloys, and/or metal salts or metal nitrates of plural metals to be utilized in the magnet material are dissolved as precursors in water or an acid to produce a water based solution, as represented by step 12. The materials typically include samarium and cobalt in proportions to produce a 1-5 (36 weight percent samarium, balance cobalt) magnet or 2-17 magnet, and in such case the alloy components on a weight percent basis would be 26.5% samarium, 20% iron, 4-8% copper, 1-3% zirconium and the remainder in cobalt as a 30% solution of nitric acid. Neodymium, iron, and boron materials may also be used. The acid solution, which ensures a high inner mixing of the metallic particles, is atomized in the step 14 into a very fine mist of extremely small droplet size, on the order of tens of microns diameter. The droplets in the mist will each contain a highly homogeneous proportion of the various metal salts in the solution and because of the liquid dynamics of solutions exhibit a high degree of intimacy between the various components.

Figure 2:
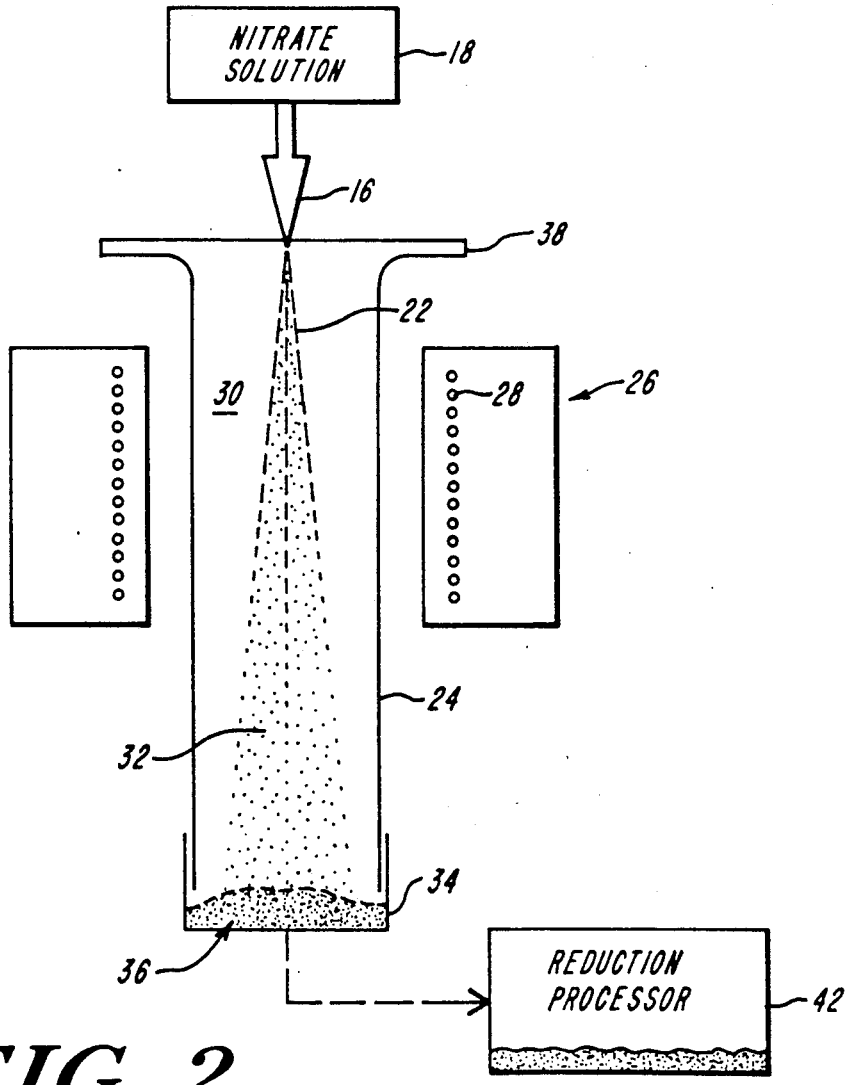
FIG. 2 is a schematic diagram of a reaction furnace for producing fine grained metal oxide powders of plural metal components according to the present invention.
Figure 3:
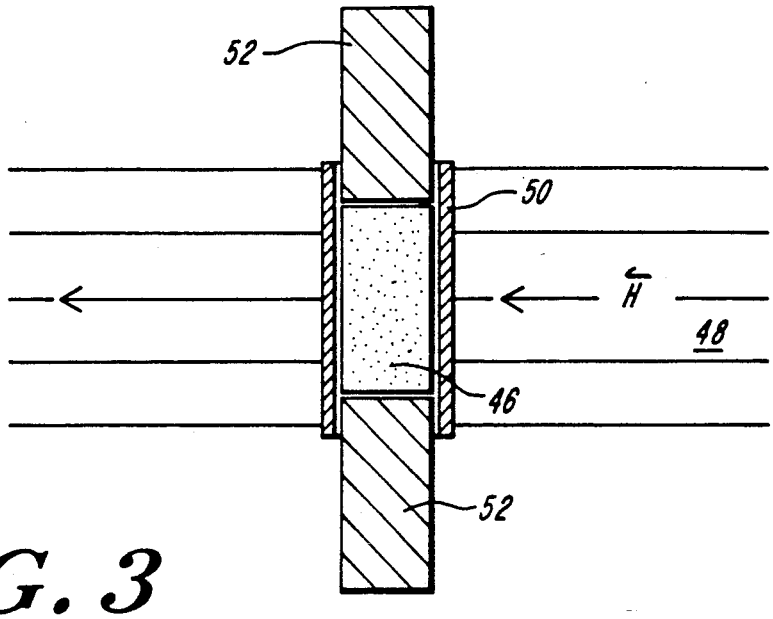
FIG. 3 is a schematic diagram of apparatus utilized in aligning and providing initial compaction of metal alloy powders according to the present invention.

As illustrated in FIG. 2, a nozzle 16 through which a nitrate solution 18 is atomized may be a fine mist nozzle or an ultrasonic nozzle to produce an even finer mist. By reducing the concentration of the metal salts in the solution, a smaller particle size ca be achieved in the powder that is synthesized.

That powder is produced in a step 20 in which the finally atomized mist 22 is dropped through a column 24 within a furnace 26, formed by annularly disposed heating coils 28 about a hot zone 30. The furnace is operated optionally in the range of approximately 600° C. to 1150° C. at which temperature the droplets in the mist 22 are dried, the metal salts being oxidized to corresponding metal oxide particles 32 which collect in a collector 34 as a fine particle powder 36. For 1-5 magnets, samarium and cobalt exist in the approximate ratio of 36:64. The other components in the solution, during traversing of the hot zone 30, form volatile materials which are driven to the top of the furnace 26 where they may be exhausted by an exhaust 38.

The fine grain powder 36 is subsequently reduced to a metal alloy powder, in a reduction step 40, using reduction apparatus 42. Typically the oxide reduction proceeds in a hydrogen atmosphere within the reduction processor 42 and calcium metal and/or calcium hydride $CaH_2$ is utilized as the reducing agent. The resulting metal alloy powder has a similar fine particle size resulting from chemical reduction of the original metal oxide particles and possesses the same high level of metal to metal intimacy and metal to metal proportion homogeneity as in the metal oxide powder.

Figure 4:
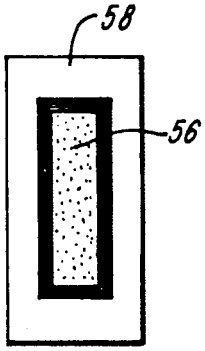
FIG. 4 is a diagramatic representation of the final densification step for producing the magnetic element according to the present invention.
Figure 5:
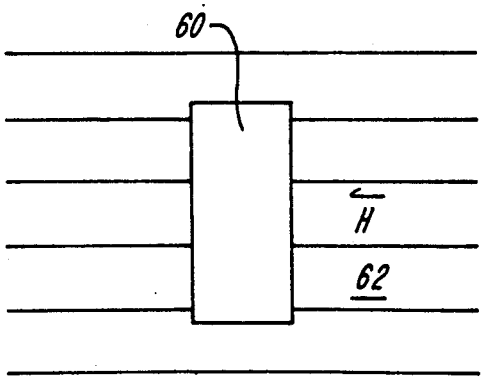
FIG. 5 is a diagramatic representation of the magnetization of the densified metal magnet to produce the high performance rare-earth permanent magnet of the present invention.

This fine particle metal powder is then typically aligned and cold compacted in an initial step 44 in which powder 46 is aligned in a magnetic field 48 and compacted within a compaction press 50, typically using pressure cylinders 52 or other devices as known in the art, to achieve a green compact. The green compact is removed from the cold compaction apparatus 50 and, in a step 54, subjected to further densification as by sintering or hot isostatic pressing. In FIG. 4 processing the green compact 56 is highly consolidated to near theoretical density, in a hot isostatic pressing canister 58 or optionally applied to a sintering environment. The sintered or hot isostatically pressed green compact 56 emerges as a highly consolidated magnet element 60, which may have been formed in the ultimately desired shape and size, or machined to that state. The element 60 is magnetized in a magnetic field 62, illustrated in FIG. 5, to achieve the final magnetization and produce a high performance magnet according to the present invention.

The present invention achieves extremely high magnetic properties by producing a magnetic material of extreme microstructure and chemical homogeneity. This in turn results from utilizing a technique for producing the metal oxide and metal alloy powder particles of extremely small size with high levels of homogeneity and intimacy of component mixing from a fine atomization of a metal salt solution.

The exemplary implementation described above is to be seen as non-limiting, the scope of the invention being solely as defined in the following claims.

We claim:

1. Apparatus for producing rare-earth permanent magnet precursors of high homogeneity metal alloy powders comprising:

a reservoir of a nitric acid solution of salts of plural metals;

a nozzle means for generating a mist of droplets by atomization of said solution;

means for heating the mist to dry the liquid components of the droplets and oxidize the metal salts producing controlled, fine sized powders of the resulting metal oxides wherein each powder grain contains each of said plural metals in homogeneous proportions;

means for collecting the metal oxide powder particles;

means for reducing the metal oxides to metal alloy particles each containing said plural metals in homogeneous proportions.

2. The apparatus of claim 1 wherein said acid solution includes said metals dissolved in nitric acid.

3. The apparatus of claim 1 wherein said nozzle means includes a means for generating a mist containing samarium and cobalt.

4. The apparatus of claim 3 wherein said means for heating produces samarium and cobalt in the metal oxide in approximately the weight ratio of 6:64.

5. The apparatus of claim 1 wherein said nozzle means includes a means for generating a mist containing zirconium, samarium, iron, cobalt, and copper.

6. The apparatus of claim 1 wherein said nozzle means includes a means for generating a mist containing rare-earth and iron components.

7. The apparatus of claim 6 wherein said nozzle means includes a means for generating a mist containing at least one of neodymium, iron, and boron.

8. The apparatus of claim 1 wherein said means for heating includes means for heating the mist to the range of 600° to 1150° centigrade.

9. The apparatus of claim 1 further including means for controlling solution concentration and droplet size to produce metal oxide powder particles measurable in microns on the order of tens of microns in diameter.

10. The apparatus of claim 1 wherein said means for reducing further includes means for reducing the metal oxide powder particles with calcium.

11. The apparatus of claim 1 further including means for producing a solid magnet element from the metal alloy particles.

12. The apparatus of claim 11 wherein said magnet producing means includes means for aligning the metal alloy particles.

13. The apparatus of claim 12 wherein the magnet producing means includes means for cold compacting the aligned metal alloy particles.

14. The apparatus of claim 13 wherein the magnet producing means includes means for densifying the aligned cold-compacted metal alloy particles.

15. The apparatus of claim 14 wherein said densifying means includes means for sintering or hot isostatic pressing.

16. The apparatus of claim 15 wherein said magnet producing means includes means for magnetizing the densified metal alloy structures.

* * * * *

UNITED STATES PATENT AND TRADEMARK OFFICE

CERTIFICATE OF CORRECTION

PATENT NO. : 5,044,613

DATED : September 3, 1991

INVENTOR(S) : Kaplesh Kumar, et al.

It is certified that error appears in the above-identified patent and that said Letters Patent is hereby corrected as shown below:

Column 3, line 1, "size ca be" should read --size can be--.

Column 4, line 26, "6:64" should read --36:64--.

Signed and Sealed this

Third Day of August, 1993

*Attest:*

Michael K. Kirk

MICHAEL K. KIRK

*Attesting Officer*

*Acting Commissioner of Patents and Trademarks*